United States Patent [19]

Padgett, Jr. et al.

[11] Patent Number: 4,700,841

[45] Date of Patent: Oct. 20, 1987

[54] METHOD FOR PACKING FLEXIBLE, FLAT PACKAGES INTO A CARTON

[75] Inventors: Lonnie W. Padgett, Jr., Acworth; Charles L. Davis, Atlanta, both of Ga.

[73] Assignee: Kimberly-Clark Corporation, Neenah, Wis.

[21] Appl. No.: 848,430

[22] Filed: Apr. 4, 1986

[51] Int. Cl.[4] ..... B65D 85/62; B65B 11/58

[52] U.S. Cl. ..... 206/499; 53/449; 206/440

[58] Field of Search ..... 53/170, 174, 175, 171, 53/449, 469, 473, 446, 544; 206/440, 499, 526, 804; 220/403

[56] References Cited

U.S. PATENT DOCUMENTS 3,399,762 9/1968 Potter ..... 206/499

4,607,748 8/1986 Folke ..... 206/804

*Primary Examiner*—Robert L. Spruill

*Assistant Examiner*—Donald R. Studebaker

*Attorney, Agent, or Firm*—Patrick C. Wilson

[57] ABSTRACT

A method and configuration for packing flexible, flat packages in a carton for easy removal includes stacking the packages in a stack which has a height that is less than its length or width, placing the stack in a plastic bag within the carton on edge so that the stack fits loosely between the sides of the carton, and rotating the plastic bag and stack so that the packages lay flat in the carton and the neck of the plastic bag wraps around the stack.

7 Claims, 6 Drawing Figures

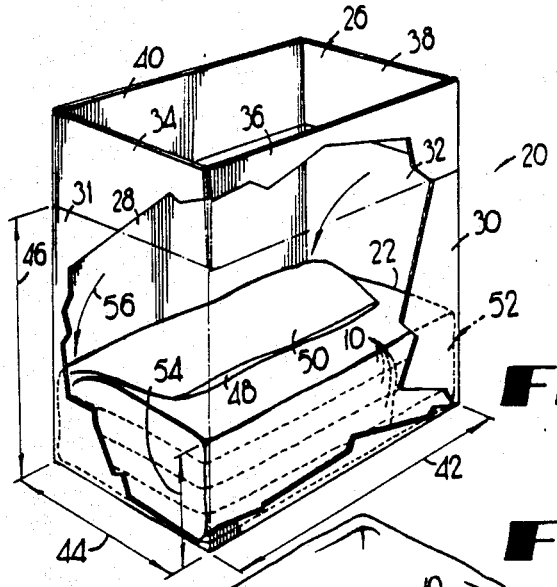
FIG 4
FIG 5
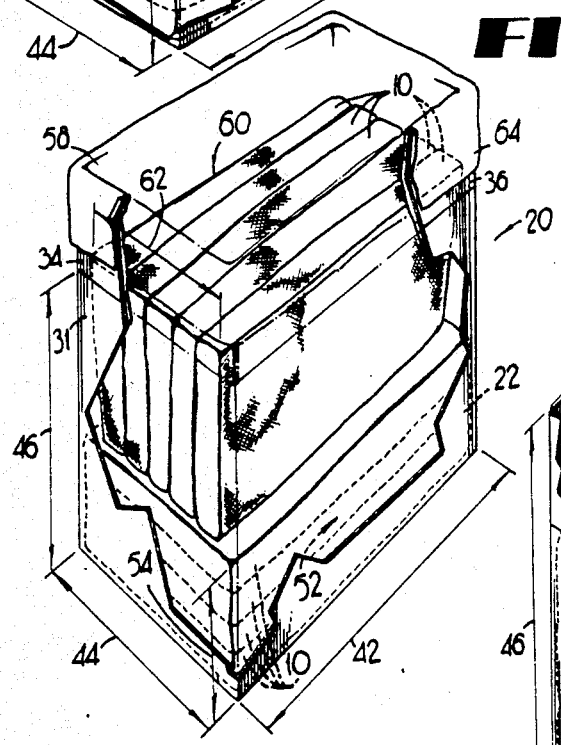
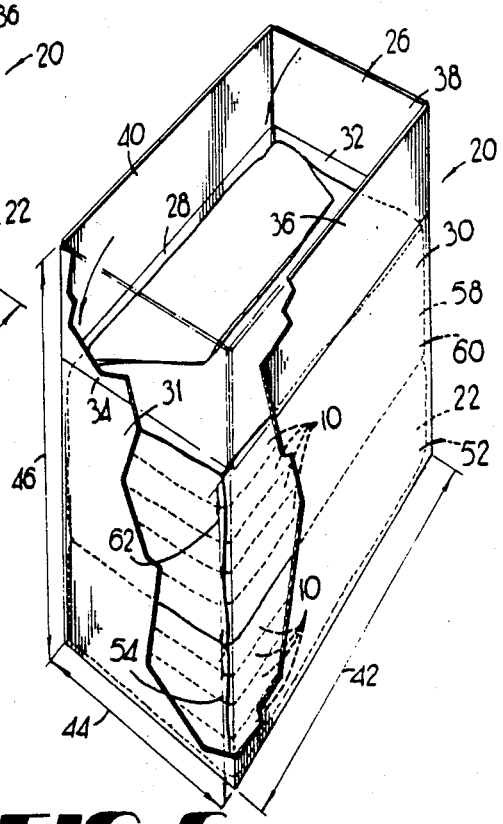
FIG 6

METHOD FOR PACKING FLEXIBLE, FLAT PACKAGES INTO A CARTON

BACKGROUND OF THE INVENTION

This invention relates generally to methods for packing cartons, and more particularly concerns a method for packing flexible, flat packages into a carton in such a way as to facilitate removal of the flat packages from the carton.

Conventionally, after disposable medical products, such as surgical packs and components including drapes, gowns, and the like, are manufactured, those products are folded, sterile wrapped, and sealed into kraft bags to produce a flexible, flat package. A number of those flexible, flat packages are then stacked one on top of the other, and the resulting stack is placed in an open top, plastic liner bag. The liner bag is large enough so that there is an excess portion or neck provided between the bag's top opening and the stack of packages. The liner bag with its contents is lowered by means of the bag's neck into a corrugated carton, and the carton is sealed. Conversely, the liner bag can be placed inside the corrugated carton and then filled with the flexible flat packages.

The length and width of the flat packages are approximately the same as the length and width of the corrugated carton so that the stack of packages fits snugly within the walls of the corrugated carton. The thickness of each flat package is such that the combined thicknesses of the packages produces a stack having a height equal to the height of the carton, thereby filling the carton.

Upon receipt in a hospital of a carton of surgical packs or components packed in the described conventional fashion, the carton is opened, the liner bag and flat packages are pulled from the carton by grasping the bag's neck, ahd the carton is discarded in order to eliminate any contaminants that may have become attached to the carton during its shipment and storage. The surgical packages are left in the plastic liner bag in the hospital's storage area so that the plastic liner bag can serve as a dust cover during storage.

Because the packages of surgical supplies fit snugly within the walls of the corrugated carton and because of the affinity of the plastic liner for the inside walls of the corrugated carton, it is difficult to remove the liner bag with the packages therein from the cardboard carton by merely grasping the neck of the liner bag and pulling the liner bag through the top opening of the carton. Removal of the liner bag and packages is made difficult not only by the friction between the sides of the liner bag and the corrugated carton but also by a partial vacuum that is created between the liner bag and the bottom of the carton as the liner bag is withdrawn from the corrugated carton.

For example, where nine surgical drape packages are stacked within a corrugated carton having a length of 17.625 inches, a width of 11.3125 inches, and a height of 16.25 inches, and where the liner bag and the surgical packages weigh approximately 19 pounds, the amount of force exerted on the neck of the liner bag that is required to pull the liner bag with the nine surgical packages therein from the carton is about 50 pounds.

Because the force required to extract the liner bag and its contents from the carton is greater than 19 pounds, the gross weight of the contents of the full carton, it is necessary to have some means for holding the carton down while the bag is pulled out of the carton. Consequently the simple task of removing the plastic bag containing the surgical packages from the carton for inventory purposes may ultimately require two people, one to hold the carton down and a second person to pull the plastic bag and its contents from the carton.

SUMMARY OF THE INVENTION

It is therefore an object of the present invention to provide a method and configuration for packing flexible, flat packages within a liner bag within a carton so that the liner bag with the flat packages therein can be easily removed from the carton.

Particularly, it is an object of the present invention to provide a method and configuration for packing flexible, flat packages within a liner bag within a carton so that upon grasping the neck of the liner bag, the side wall restriction is lessened and the partial vacuum formed between the bottom of the liner bag and the carton is broken, thus facilitating removal.

In order to realize the objectives of the present invention, the packing method and configuration of the present invention include placing a stack of the flat packages in a liner bag. The liner bag is initially oriented within the carton with its neck and opening extending toward and coinciding with the opening of the carton. The stack of flat packages is oriented within the liner bag in an initial position so that the stack of packages fits snugly between the ends of the carton and fits loosely between the sides of the carton. The liner bag and stack of packages are then rotated together through approximately 90° to a final position within the carton so that the stack fits snugly between both the sides and the ends of the carton. The rotation of the liner bag and stack positions the liner bag so that the neck of the liner bag extends around the stack from a point adjacent the side of the carton to a position on the top of the stack that is accessible from the opening of the carton.

When the carton is subsequently opened for removal of the liner bag with its contents, the user simply pulls on the neck causing the bag containing the stack to rotate within the carton from its snug-fitting final position which seals the partial vacuum at the bottom of the carton toward its loose-fitting initial position which relieves the side wall restriction and the partial vacuum and allows easy removal of the liner bag and its contents.

In the case where a carton is substantially higher than it is wide, the number of packages packed in the carton will be divided into two or more stacks. Each stack has its own separate liner bag which has been rotated from a loose-fitting initial position between the side walls to a snug-fitting final position with the neck of the liner bag extending around the stack from a point adjacent the side of the carton to the top of the stack.

Other objects and advantages of the invention will become apparent upon reading the following detailed description and upon reference to the drawings.

BRIEF DESCRIPTION OF THE DRAWINGS

FIG. 4 is similar to FIG. 3 and in addition shows the stack of flat packages being rotated along with the liner bag from the initial, loose-fitting position to the final, snug-fitting position within the carton;

FIG. 5 is similar to FIG. 4 and in addition shows a second stack of flat packages in the initial, loose-fitting position with the carton; and FIG. 6 is similar to FIG. 5 and in addition shows the second stack of flat packages rotated into the final, snug-fitting position within the carton.

DETAILED DESCRIPTION OF THE INVENTION

While the invention will be described in connection with the preferred embodiment and method, it will be understood that we do not intend to limit the invention to that embodiment or method. On the contrary, we intend to cover all alternatives, modifications, and equivalents as may be included within the spirit and scope of the invention as defined by the appended claims.

Figure 1:
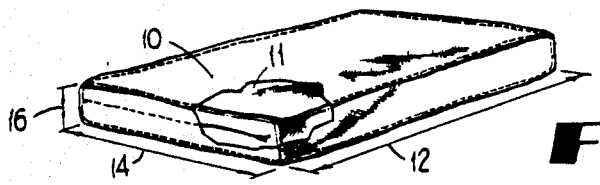
FIG. 1 is a perspective view, partially cut away, of a flexible, flat package to be packed in a carton in accordance with the present invention.
Figure 2:
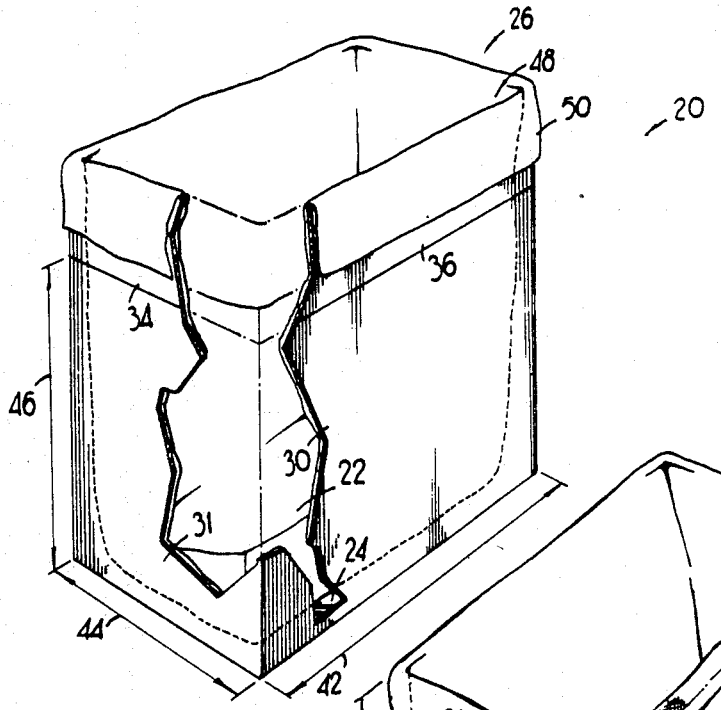
FIG. 2 is a perspective view of the carton used in connection with the present invention with portions cut away to show a plastic liner bag disposed within the carton prior to packing the flexible flat packages into the carton.

Turning to FIG. 1, there is shown a flexible, flat package 10 containing a folded surgical drape 11, for example. The package 10 has a length 12, a width 14, and a thickness 16. The package is a kraft bag and is flexible as one of ordinary skill in the art would expect from the combination of a folded surgical drape packaged within a kraft bag. The term flat means that the thickness dimension of the individual package 10 is less than either the length or the width of the package.

Turning to FIGS. 2–6, there is shown a carton 20 with a liner bag 22 disposed therein. The carton 20 has a bottom 24, a top opening 26, sides 28 and 30, and ends 31 and 32. Flaps 34, 36, 38, and 40 are disposed around the periphery of top opening 26 for closing the top opening once the carton has been filled. The bag liner 22 has an opening 48 coinciding with the opening 26 of the carton and a neck portion 50, part of which is folded over and outside of the flaps 34, 36, 38, and 40.

The carton 20 has a length 42 and a width 44 which are approximately equal to the length 12 and the width 14 of the flat package 10. Conventionally, the flat packages 10 are stacked within bag 22 one on top of the other on the bottom 24 of the carton to a height equal to the height of the carton. Because the length and width of the flat packages are approximately the same as the length and width of the carton, there is a snug fit between the edges of the flat packages and the sides and ends of the carton. Once the liner bag 22 has been filled with flat packages, the neck portion 50 of the liner bag 22 is removed from around the outside of the flaps of the carton, twisted closed, and the flaps of the carton are closed and sealed.

In order to remove the liner bag 22 with the flat packages contained therein, the flaps are opened, and the neck 50 of the liner bag is grasped in order to pull the liner bag with its contents from the carton. In such conventional packaging, the neck 50 is located on top of the stack of packages at the approximate midpoint of the box opening. Because the flat packages fit snugly between the sides and ends of the carton, a partial vacuum is created between the liner bag 22 and the bottom 24 of the carton, which partial vacuum together with the sidewall restriction makes removal of the liner bag with its contents difficult.

In order to overcome the difficulty of removing the liner bag with its contents as previously described, there is shown in FIGS. 3–6 a method for packing the carton with the liner bag which provides for easy removal of the liner bag with its contents. The first step in packing the carton in accordance with the present invention is to form a stack of packages 52 (in this case four packages). The stack has a height 54, a length 12 (the same as the length of flat package 10), and a width 14 (the same as the width of flat package 10). The height 54 of the stack 52 is equal to four times the thickness 16 of the package 10. In addition, the height 54 of the stack 52 is less than the width 44 of the carton. It is also necessarily less than the length 42 of the carton 20.

Figure 3:
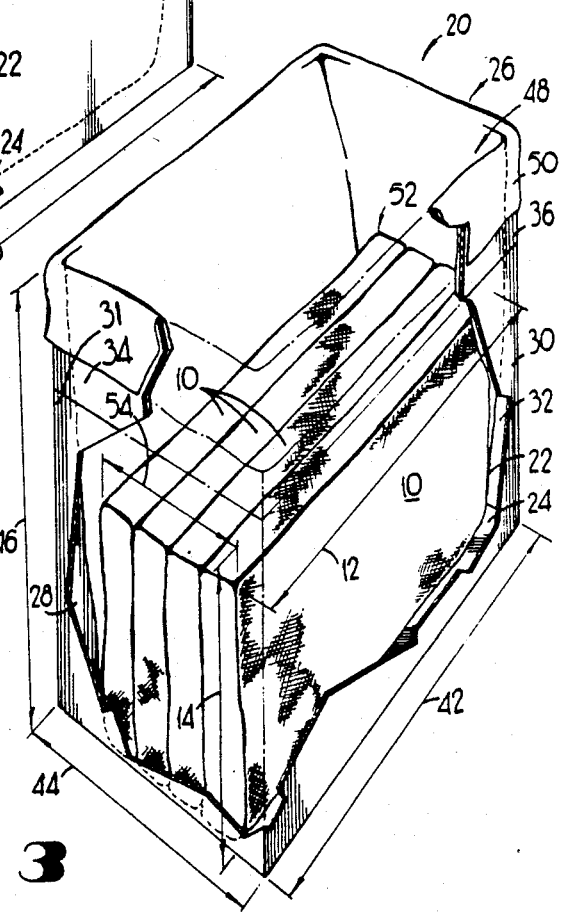
FIG. 3 is similar to FIG. 2 and in addition shows a stack of four flexible, flat packages disposed within the liner bag within the carton in the initial, loose-fitting position.

As shown in FIG. 3, the stack 52 and liner bag 22 are placed in the carton 20 in an initial position with the packages 10 on edge. Because the height of the stack 54 is less than the width 44 of the carton, the stack 52 in its initial position fits loosely between the sides 28 and 30 of the carton. The neck 50 of the bag 22 extends above the stack, coincides with the carton opening 26, and is folded over the outsides of the flaps of the carton.

Turning to FIG. 4, it can be seen that the packing of the carton continues by removing the neck 50 from the flaps of the carton and gathering the neck 50 together to create a handle. The stack 52 and the bag 22 are then rotated together through approximately 90° as indicated by the arrow 56 to a final, snug-fitting position in the carton with the packages 10 laying flat on the bottom 24 of the carton. Because the stack 52 is formed of flexible packages 10 and the carton has a certain amount of "give", such rotation can be accomplished even though geometrically the stack's diagonal is greater than the width 44 of the carton 20.

Once the stack and liner bag have been rotated into the final position shown in FIG. 4, the stack's width 14 corresponds to the width 44 of the carton so that the stack in its final position fits snugly in the bottom of the carton. It should be noted that as a result of the rotation of the bag and stack, the neck 50 of the bag 22 extends around the stack 52 from a position adjacent the side 28 of the carton to a position overlapping on the top of the stack 52. Additionally, if vertical space within the carton is limited, the neck 50 of the bag 22 can be twisted and stuffed down between the bag and the side 28 of the carton.

Because the height 54 of the stack 52 is less than the height 46 of the carton, it is necessary to repeat the packing process with another liner bag 58 and another stack 60 of packages 10. In this case there are five packages in stack 60. The height 62 of the stack 60 is, however, still less than the width 44 of the carton so that the stack 60 in its initial position shown in FIG. 5 with the packages 10 on edge fits loosely between the sides 28 and 30 of the carton.

Turning to FIG. 6, it can be seen that stack 60 and liner bag 58 have been rotated approximately 90° into a final position where the stack 60 fits snugly between the sides 28 and 30 of the carton, and the packages 10 lie flat. Likewise, the neck 64 of the bag 58 has been gathered to form a handle and extends around the stack 60 from a position adjacent the side 28 of the carton to a position overlying the top of the stack 60. The combined heights 54 and 62 of stacks 52 and 60 respectively are approximately equal to the height 46 of the carton 20. As a result, the carton is full, and the flaps 34, 36, 38, and 40 are then closed to seal the carton.

Once the carton 20 having the described packing configuration of the present invention has been delivered to a hospital, for example, the packing process is simply reversed. The flaps 34, 36, 38, and 40 are opened, and the person unpacking the carton grasps the neck 64 of the bag 58. As the person pulls on the neck 64, the neck which extends around the stack 60 to a position adjacent the side 28 of the carton creates a torque on the stack 60 which causes it to rotate toward the initial position shown in FIG. 5. As stack 60 is rotated toward the initial position shown in FIG. 5, the height 62 of the stack 60 coincides with and is less than the width 44 of the carton so that there is no seal along the sides 28 and 30 of the carton. Without the seal along sides 28 and 30 of the carton, any partial vacuum formed under the bag 58 is relieved, thereby facilitating removal of the stack 60 in the liner bag 58. Likewise, bag 22 is removed by grasping the neck 50 and rotating the stack 52 toward its initial loose-fitting position for easier removal.

In order to emperically demonstrate the advantages of the packing configuration and method of the present invention, a corrugated carton having a length of 17.625 inches, a width of 11.3125 inches, and a height of 16.250 inches was packed with nine flat packages weighing approximately 19 pounds as set out in the examples below.

EXAMPLE 1

The corrugated carton was packed in the conventional fashion with nine flat packages in a single liner bag with the opening of the liner bag on top of the stack.

EXAMPLE 2

The corrugated carton was packed with two liner bags, the lowermost having four flat packages and the uppermost having five flat packages. The necks and openings of each liner bag were oriented in a conventional fashion on top of the stacks of packages.

EXAMPLE 3

The carton was packed in accordance with the present invention with two liner bags, the lowermost having four flat packages and the uppermost having five flat packages. The necks of each of the liner bags, in accordance with the present invention, extended from a position adjacent the carton sides around the stack toward the opening of the carton.

For each packing configuration, Examples 1 through 3, the carton was packed five times and the amount of maximum forces required for removing the liner bags and contents were recorded. Table I below sets forth the maximum forces required to remove the liner bags and contents for each of the packing configurations of Examples 1 through 3.

TABLE I

| Examples | First Pack (lbs.) | Second Pack (lbs.) | Third Pack (lbs.) | Fourth Pack (lbs.) | Fifth Pack (lbs.) |
|---|---|---|---|---|---|
| 1. Conventional: 9 packages-1 liner bag | 48 | 52 | 52 | 53 | 54 |
| 2. Modified Conventional: | | | | | |
| lower liner bag -4 packages | 22 | 21 | 35 | 17 | 32 |
| upper liner bag -5 packages | 19 | 27 | 35 | 35 | 26 |
| 3. Present invention: | | | | | |
| lower liner bag -4 packages | 12 | 10 | 10 | 10 | 9 |
| upper liner bag -5 packages | 14 | 20 | 14 | 13 | 13 |

As can be seen from Table I, the packing method of the present invention greatly improves upon either of the conventional packing methods. The most dramatic evidence of this improvement is found in the reduction of the average forces required to extract the two-bag configuration from cartons packed according to the present method as compared to cartons packed in the conventional manner.

The average amount of force needed to pull a conventionally packed top bag of five packages was 28 pounds, whereas the same bag and number of packages packed according to the present method only required an average of 15 pounds. This signifies a 48% reduction in the amount of force needed to extract the top bag. With the bottom bag containing four packages, the conventional method required an average of 25 pounds of force for removal, whereas the bottom bag packed according to the present invention only required an average of 10 pounds of force. The improved packing method of the present invention resulted in a 60% reduction in the amount of force needed to extricate the liner bag and its contents. Consequently, the present method of packing allows one person to remove the contents of the carton with much less effort than is needed to remove the same contents from a carton packed according to a conventional method.

Having thus described the present invention in detail, it should be understood that various modifications and changes can be made in the invention without departing from the scope and spirit of the following claims.

We claim:

1. A method for packing a stack of flexible, flat packages into a carton having a bottom, sides, ends and a top opening, to facilitate removal therefrom, wherein the method comrises:

a. placing the stack of packages in a liner bag having a body and a neck;

b. orienting the liner bag within the carton with the neck extending toward and coinciding with top opening of the carton and orienting the stack of packages within the bag in an initial position with respect to the carton so that the stack fits loosely between the sides of the carton; and c. rotating the bag and stack of packages together to a final position in which the stack fits snugly between the sides and the ends of the carton and the neck extends around the stack and toward the carton opening from a position adjacent the carton sides.

2. The method of claim 1, wherein the stack has a height and a length, and its height is less than its length.

3. The method of claim 1, wherein the stack has a height and a width, and its height is less than its width.

4. The method of claim 1, wherein the carton has a height and the stack has a height which is less than the height of the carton and wherein additional stacks having heights are packed into the carton by repeating steps a, b, and c of claim 1 for each additional stack until the sum of the heights of all the stacks equals the height of the carton.

5. A packing configuration for packing flexible, flat packages each having a length, a width and a thickness within a carton having a bottom, sides, a top opening, a length, a width and a height comprising:

a. a stack of the packages, the stack having a length, width, and height wherein the length and width of the stack is equal to the length and width of the packages and approximately equal to the length and width of the carton, and the height of the stack is less than its length;

b. a liner bag having a neck and a body portion for enclosing the stack, wherein when the stack is positioned within the liner bag within the carton so that the length and width of the stack coincides with the length and width of the carton, the neck of the liner bag extends around a portion of the stack from a position adjacent the side of the carton toward the opening of the carton.

6. The packing configuration of claim 5, wherein the height of the stack is less than its width.

7. The packing configuration of claim 5, wherein a number of stacks each having a height are within the carton such that the combined heights of the stacks are approximately equal to the height of the carton.

* * * * *